US006291754B1

(12) United States Patent
Gatzen et al.

(10) Patent No.: US 6,291,754 B1
(45) Date of Patent: Sep. 18, 2001

(54) EXTERNALLY MOUNTED ADJUSTABLE DAMPING SYSTEM FOR DRUM HEAD

(75) Inventors: Robert A. Gatzen, Newington; Donald R. Dressler, Glastonbury, both of CT (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 09/713,375

(22) Filed: Nov. 15, 2000

(51) Int. Cl.[7] ..... G10D 13/02
(52) U.S. Cl. ..... 84/411 M; 84/411 P
(58) Field of Search ..... 84/411 M, 411 P, 84/411 R

(56) References Cited

U.S. PATENT DOCUMENTS 4,325,281 * 4/1982 Hardy ..... 84/411 M
5,031,499 * 7/1991 Wang ..... 84/411 M
5,892,168 * 4/1999 Donohoe ..... 84/411 M
5,920,021 * 7/1999 Good ..... 84/411 M

* cited by examiner

*Primary Examiner*—Shih-Yung Hsieh
(74) *Attorney, Agent, or Firm*—Alix, Yale & Ristas, LLP

(57) ABSTRACT

An externally mounted adjustable damping system for drumhead allows the sound characteristics of a drum to be easily adjusted without disassembly of the instrument. The externally mounted adjustable damping system includes a mounting fixture adhesively attached to the outside surface of a drumhead. The mounting fixture defines an annular channel for receiving damping elements of various materials and configurations. The damping elements may be rings or segments of vibration absorbent material placed to achieve the desired sound pattern from the instrument.

22 Claims, 7 Drawing Sheets

EXTERNALLY MOUNTED ADJUSTABLE DAMPING SYSTEM FOR DRUM HEAD

BACKGROUND OF THE INVENTION

1. Field of the Invention

This invention relates generally to the field of musical drums, and is more particularly directed to an externally mounted adjustable damping system for a drumhead.

2. Description of the Related Art

Modern drumheads are typically constructed of single or multiple layers of synthetic plastic materials such as polyethylene, polypropylene, polyester and the like. A drumhead sheet of plastic material is formed to a shape that will fit over the open end of a drum shell. The peripheral edges of the formed drumhead sheet are secured within a rigid drum hoop, typically constructed of metal. Tensioning devices engage the hoop and adjustably tension the drumhead over the drum shell. Generally speaking, higher tension on the drumhead produces higher pitch vibrations when the drumhead is struck.

Plastic sheet materials have proven to be exceptionally durable, attractive and adaptable to the manufacture of drumheads for musical drums. Synthetic sheet materials, however, also have some undesirable vibration characteristics that have come to the attention of both musicians and sound engineers. Synthetic drumheads have a tendency toward sustained vibration where the peripheral portions of the drumhead emit unwanted ringing and overtones that detract from the sound of the primary fundamental tones of the drum.

Undesirable sustain and overtones are particularly a problem with bass drums. The desirable vibration pattern for bass drums is usually a sharp initial sound of the fundamental tone when the drumhead is struck (the attack of the drumhead) followed by a rapid suppression of further vibration. This vibration pattern permits each bass drum strike to be distinctly heard, even if the drum is struck rapidly, as in rock, jazz, Latin and other forms of popular music. Sustain is undesirable in a bass drum because it can lead to a muddled sound in the low frequency portion of a musical arrangement. The deficiencies of synthetic drumheads have become particularly apparent with the widespread use of highly sensitive and accurate digital recording technology.

Various approaches have been taken to suppress undesirable sustain and/or unwanted overtones in a synthetic bass drumhead. For example, tape and other laminations have been applied to the outside (playing) surface of the drumhead. Although this technique has been somewhat successful, it has been less than satisfactory in a number of respects. Perhaps most notably, the laminated material is relatively thick and thus muffles desirable sounds as well as unwanted overtones. The thickness of the lamination also alters the feel of the drum and can detract from the clarity and crispness of the fundamental tones produced when the drumhead is struck (the attack characteristics of the drumhead).

Various vibration-damping systems have been developed for attachment to or placement adjacent to the interior surface of a drumhead. U.S. patent application Ser. No. 09/492,221, assigned to the assignee of the present invention, discloses a marching bass drumhead muffle ring. The muffle ring comprises a ring of plastic sheet material affixed between the inside surface of a drumhead and the bearing surface of a drum shell. The ring is biased toward the drumhead so that damping elements inserted between the plastic ring and the interior surface of the drumhead are biased against the drumhead interior surface. The drumhead muffle ring may include a complete ring of damping material or arcuate sections of damping material positioned to tune the drumhead as desired. The thickness, composition and radial width of the ring or segments of damping material may also be varied. While this arrangement permits variable adjustment of drumhead vibration, adjustment is made quite difficult because the drum must be disassembled, reassembled and tuned for each setting.

U.S. Pat. No. 5,892,168 illustrates a drumhead with floating muffling ring affixed to the interior surface of a bass drumhead. The floating muffling ring includes a ring of damping material laminated to a ring of biasing material. This ring of laminate is adhesively affixed to the periphery of the interior surface of the struck or batter drumhead of a bass drum. When a beater strikes the batter drumhead, the initial force of the strike moves the damping material away from the drumhead, permitting the initial vibration to be somewhat unsuppressed. The biasing element urges the damping material back into contact with the drumhead so that subsequent vibrations are suppressed, particularly those of the peripheral portions of the drumhead.

There are several disadvantages to this arrangement. First, the arrangement is not adjustable. Once adhered to the interior surface of the batter drumhead of an assembled bass drum, the floating muffling ring cannot be removed and the damping effect may not be adjusted. Also, the damping element is constantly urged into contact with the drumhead by the biasing layer of the laminate, which causes an undesirable deadening of the attack characteristics of the drumhead.

The understanding in the art was that placement of damping elements on the playing surface of a drum is undesirable for cosmetic reasons. Thus, many arrangements are configured for application to the inside surface of the drumhead membrane. Access to the damping system for removal or adjustment is seriously complicated by this arrangement. Also, since a beater strike initially displaces the drumhead membrane toward the interior of the drum shell, damping systems disposed adjacent to the interior surface of the drumhead cause an undesirable suppression, or deadening of the initial attack characteristics of the drum.

SUMMARY OF THE INVENTION

The present invention in a preferred form is a drumhead vibration-damping accessory that is adhesively attached to the periphery of the outside surface of a drumhead. An annular mounting fixture circumscribes the periphery of the drumhead to define a channel for the retention of damping elements. The mounting fixture is preferably adhesively attached to the outside surface of the drumhead by foam adhesive tape or any number of specialized adhesives. The mounting fixture is preferably constructed of thin, semi-rigid plastic material and includes a radially outward portion secured to the drumhead by the adhesive and a radially inward portion spaced from the outer surface of the drumhead to define an annular space or channel. Annular or arcuate damping elements fit within the annular channel and rest adjacent to the outer surface of the periphery of the drumhead membrane.

Annular damping elements have an outer circumference configured to rest inside the annular channel formed by the mounting fixture. The radial width, axial thickness and composition of the damping element may be selected for the purpose of adjusting the sound characteristics of the drumhead. For example, a radially wider ring of damping material will generally produce greater acoustic damping than a radially narrower ring of damping material. A complete ring of damping material need not be affixed to either the drumhead or the mounting fixture as it is held in place by its position within the annular channel.

The present invention also provides for adjustment of the damping characteristics of a drumhead by use of incomplete rings or arcuate segments of damping material positioned in the annular channel of the mounting fixture. If arcuate segments of damping material are used, it may be necessary to secure the arcuate segments in the annular channel by some attachment to the mounting fixture. The attachment is preferably minimal and temporary, such as sticky tape or hook and loop-type attachment to permit easy removal, repositioning and/or replacement of the arcuate damping segments. It is preferred that the damping element or segments not be affixed to the drumhead surface and, if necessary, only affixed to the mounting fixture.

The annular mounting fixture is configured to hold the damping element or segments adjacent to the outer surface of the drumhead but not necessarily bias the damping element or segments against the outer surface of the drumhead. The damping element or segments are not fixed to the drumhead membrane and establish an independent pattern of movement during vibration of the drumhead. Due to inertia and other physical principals, the damping element will oscillate out of phase with the drumhead. The uncoupled relationship between the damping element and the drumhead results in a rapid reduction in the amplitude of drumhead vibrations. The external and peripheral placement of the damping element or segments produces a desirable damping action in which the initial response or attack of the drum in response to a beater strike is substantially unaffected. Subsequent oscillations of the drumhead are adjustably damped according to the placement and configuration of the damping elements. The damping elements are readily accessible and easily removable for adjustment purposes.

It is an object of the present invention to produce a new and improved externally mounted adjustable damping system for a drumhead.

Another object of the present invention is to provide an externally mounted adjustable damping system for a drumhead where the damping elements are not fixed to the drumhead and may be easily removed without disassembly of the drum.

A yet further object of the present invention is to provide an externally mounted adjustable damping system for a drumhead which permits the drumhead to be quickly and easily reconfigured to emit differing sound characteristics.

A still further object of the present invention is to provide an externally mounted adjustable damping system for a drumhead in which the damping action is adjustable over a range from a minimal degree of damping where the sound of the drum is substantially unaffected to a maximum degree where the sound of the drum is significantly altered.

BRIEF DESCRIPTION OF THE DRAWINGS

Other objects and advantages of the invention will be evident to one of ordinary skill in the art from the following detailed description made with reference to the accompanying drawings, in which like reference numerals are used to indicate like parts in the various views.

DETAILED DESCRIPTION OF THE PREFERRED EMBODIMENTS

Figure 1:
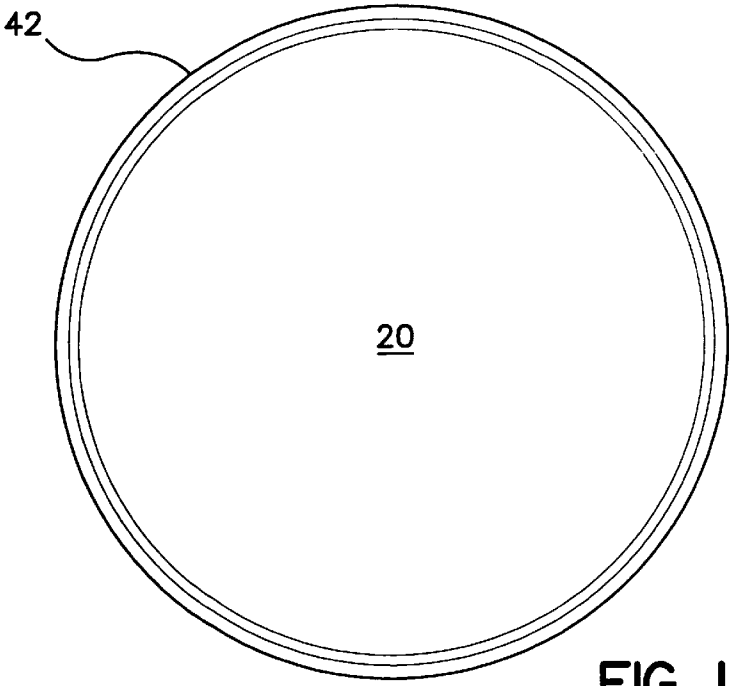
FIG. 1 is a front view of a drumhead suitable for use with the externally mounted adjustable damping system for a drumhead of the present invention.
Figure 2:
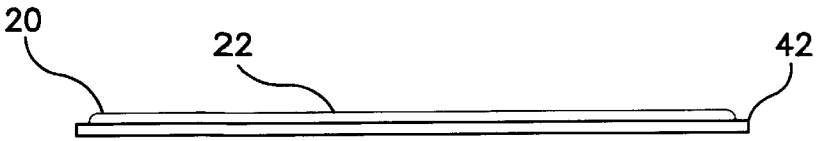
FIG. 2 is a side view of the drumhead shown in FIG. 1.

Referring now to the drawings in more detail and initially to FIGS. 1–10, the numeral 10 designates preferred embodiments of the externally mounted adjustable damping system for drumhead in accordance with the present invention. FIG. 1 is an illustration of a typical synthetic drumhead 20 to which the externally mounted adjustable damping system for drumhead may be affixed. FIG. 2 illustrates that the plastic sheet material of the drumhead membrane is molded to fit over a drum shell (not illustrated) and the periphery of the drumhead sheet is affixed within a drum hoop 42. The drumhead 20 has a substantially planar outside surface 22 which is struck by a beater (not illustrated) to induce vibrations in the air column contained within the drum shell.

These induced vibrations of the air column within a drum shell are what we hear as the primary or fundamental tone of the drum.

Figure 3:
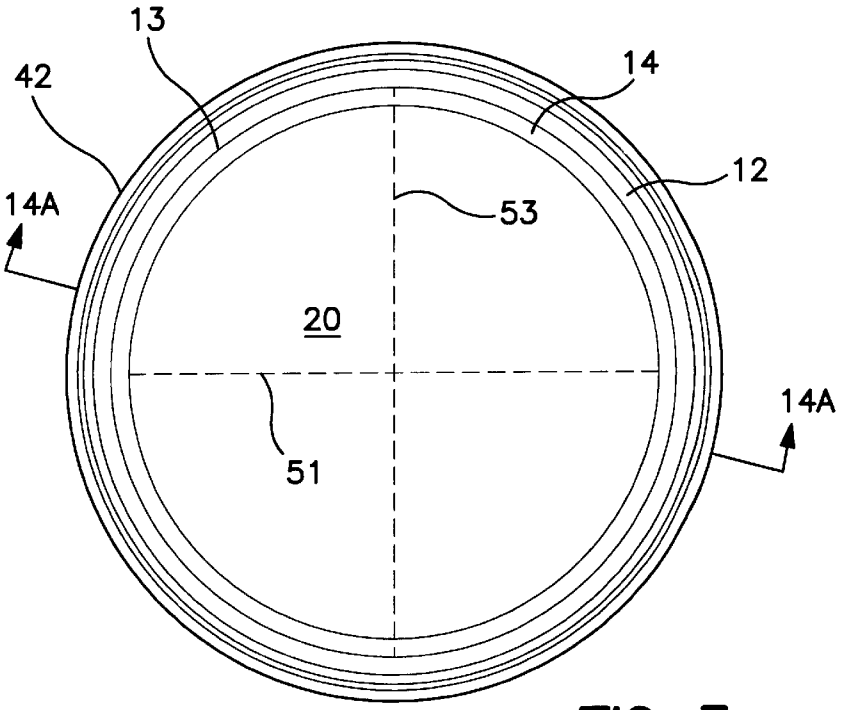
FIG. 3 is a front view of the drumhead of FIG. 1 with the mounting fixture of the externally mounted adjustable damping system for drumhead attached in accordance with the present invention.
Figure 4:
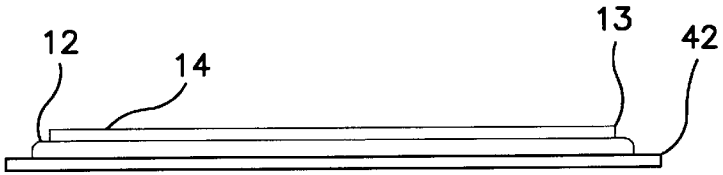
FIG. 4 is a side view of the drumhead and mounting fixture shown in FIG. 3.
Figure 14:
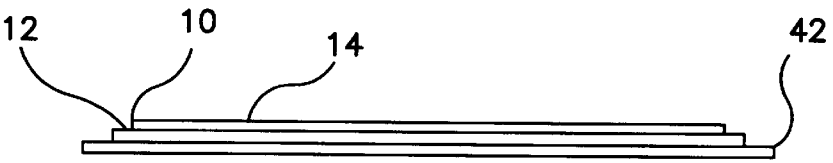
FIG. 14 is a side view of the drumhead and externally mounted adjustable damping system for a drumhead shown in FIG. 13.
Figure 14A:
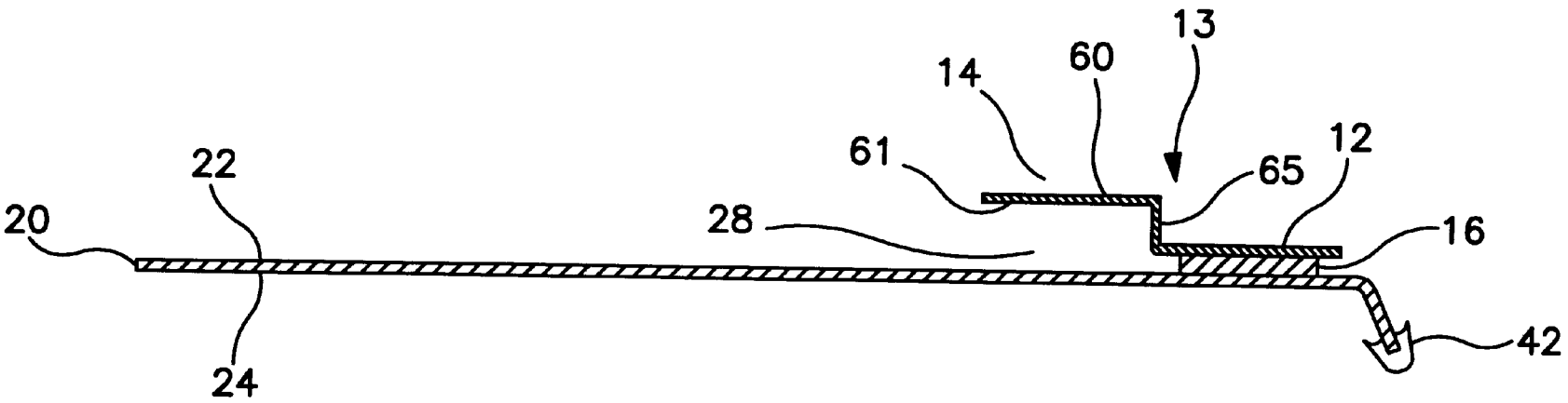
FIG. 14A is a partial sectional view through the drumhead and mounting fixture shown in FIG. 3, taken along line 14A—14A thereof.

The externally mounted adjustable damping system includes an annular mounting fixture affixed to the outside surface 22 of a drumhead 20 to define an annular channel 28 adjacent to the outside surface 22 of the drumhead. As shown in FIGS. 3, 4 and 14A, the mounting fixture 13 includes a radially outward portion 12 and a radially inward portion 14. The radially outward portion 12 is secured to the periphery of the outer surface 22 of the drumhead 20 as is best seen in FIG. 14A. The radially outward portion 12 and radially inward portion 14 are connected by annular ring 65. Annular ring 65 is oriented substantially perpendicular to the radially inward and radially outward portions of the fixture and maintains an axial spacing between them. Annular ring 65 also defines the radial extremity of the annular channel 28.

The mounting fixture may be made from any number of thermoplastic materials including: poly-vinyl chloride, polyester, polystyrene, cellulosics, polycarbonate, acrylonitrile-butadiene styrene copolymer and polyethylenes. The thickness of the mounting fixture material can be in the range of 0.005"–0.050", with the preferred thickness being approximately 0.010". The plastic material is preferably thermoformed by vacuum to define the annular channel 28.

The radially outward portion 12 is provided with an adhesive 16 applied to the bottom surface 61 of the mounting fixture 13. The axially opposed top surface 60 is continuous over the radially inward portion 14 and the radially outward portion 12 of the mounting fixture 13. The adhesive may preferably be in the form of a foam sticky tape; however, other specialized adhesives are appropriate for this attachment. Tapes known as mounting adhesives in the pressure sensitive class of adhesives are the preferred method of attachment. These tapes may be solid adhesive in the range of 0.002"–0.005" in thickness and may be permanent in nature. A foam double sided coated tape having a thickness in the range of 0.030"–0.060" is the most preferred method of attachment.

Foam tape allows for a great deal of movement between the drumhead and the mounting fixture. This flexible junction is especially important for at least the following three reasons:

1. The foam tape is capable of absorbing the strain on the bond produced when the drumhead is struck;
2. The foam tape compensates for irregularity in what may be a non-planar outside surface on a non-tensioned drumhead; and
3. The flexibility of the foam tape bond permits the attachment of the mounting fixture to a non-tensioned drumhead by compensating for the movement and stretching that occurs when the drumhead is placed under tension.

The radially inward portion 14 of the mounting fixture 13 is configured to form an annular channel 28 between the mounting fixture 13 and the outer surface 22 of the drumhead 20. A drumhead equipped only with the mounting fixture 13, as illustrated in FIG. 14A, will have vibration characteristics substantially similar to an unaltered drumhead such as that illustrated in FIGS. 1 and 2. However, the mounting fixture alone will have a perceptible and positive effect on the tone of the drumhead. The peripheral position and foam tape bond will reduce undesirable overtones from the radially outward portions of the drumhead.

Figure 5:
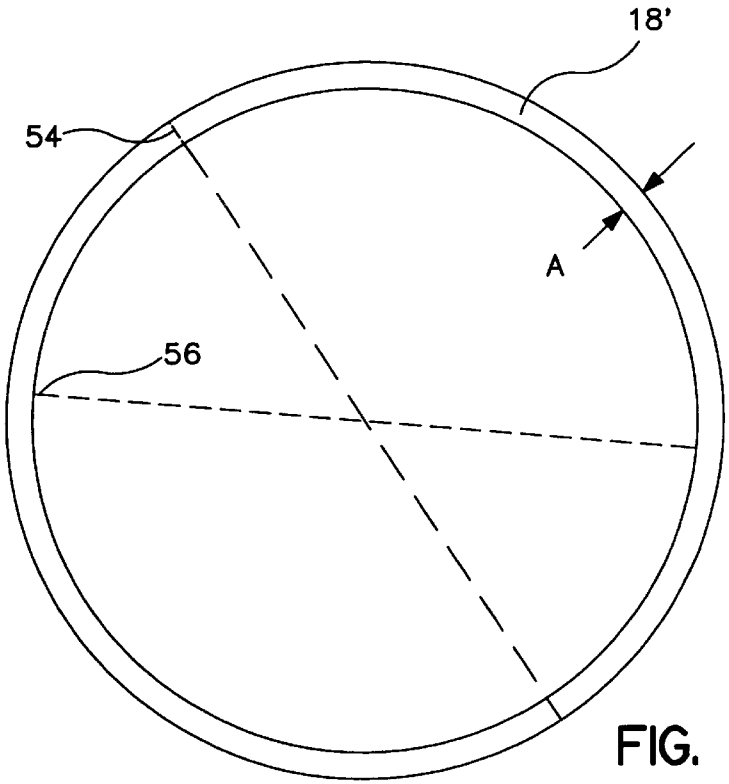
FIG. 5 is a front view of an annular clamping element of the externally mounted adjustable damping system for a drumhead in accordance with the present invention.
Figure 6:
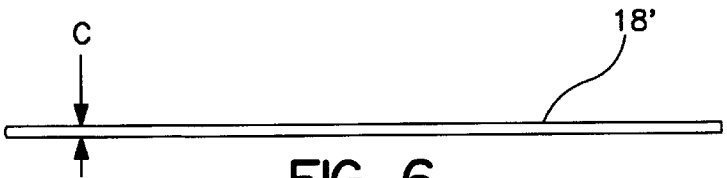
FIG. 6 is a side view of the damping element shown in FIG. 5.

FIGS. 5–8, 11 and 12 illustrate alternative embodiments of damping elements 18, 18', 18" configured to be inserted in the annular channel 28 defined by the mounting fixture 13. FIGS. 5 and 6 illustrate a damping element 18' having a width or radial dimension A and an axial dimension C. Damping element 18' has an outer diameter 54 substantially equal to the outer diameter of annular channel 28. The radial dimension A of the damping element 18' produces an inner diameter 56.

Figure 7:
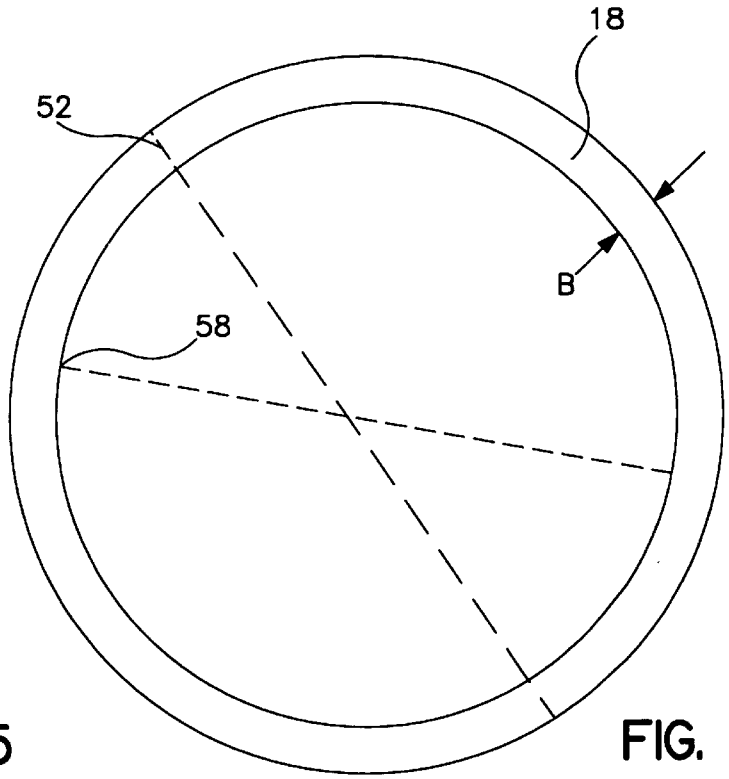
FIG. 7 is a front view of a second embodiment of a damping element in accordance with the present invention.
Figure 8:
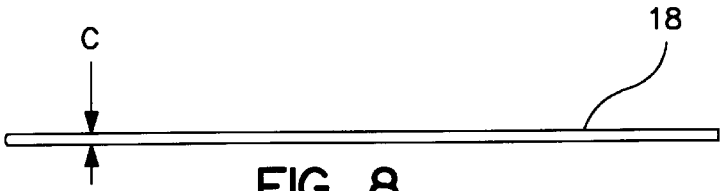
FIG. 8 is a side view of the damping element shown in FIG. 7.

FIGS. 7 and 8 illustrate damping element 18 having an increased width or radial dimension B. The axial dimension C is the same as the axial dimension C of damping element 18'. The outer diameter of damping element 18 is substantially the same as the outer diameter 54 of damping element 18' because both damping elements are configured for use with the mounting fixture illustrated in FIGS. 3, 4 and 14A. The increased radial dimension B of damping element 18 results in a smaller inner diameter 58 than the inner diameter 56 of damping element 18'.

Although many materials may produce a damping effect when placed in the mounting fixture, a preferred material is polyethylene foam. The foam has a density in the range of 2–6 lbs per cubic foot with the preferred density being 2 lbs per cubic foot. The axial dimension C of the damping elements can vary from 0.060"–0.50" with 0.250" being preferred. The radial dimension A, B may be in the range of 0.50"–3.0". The embodiments illustrated in FIGS. 5 and 7 have radial dimensions A of 0.750" and B of 1.50", respectively.

Figure 9:
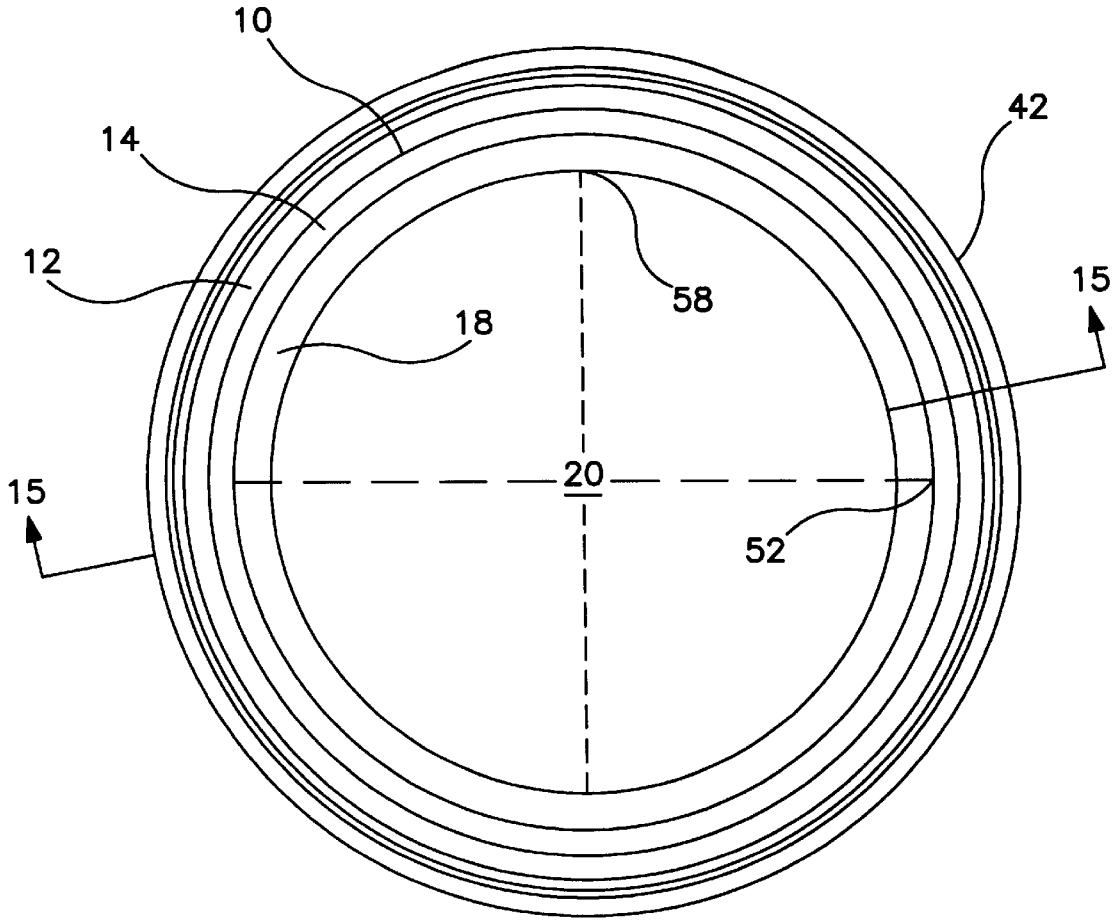
FIG. 9 is a front view of a drumhead with an externally mounted adjustable damping system for a drumhead attached in accordance with the present invention.
Figure 10:
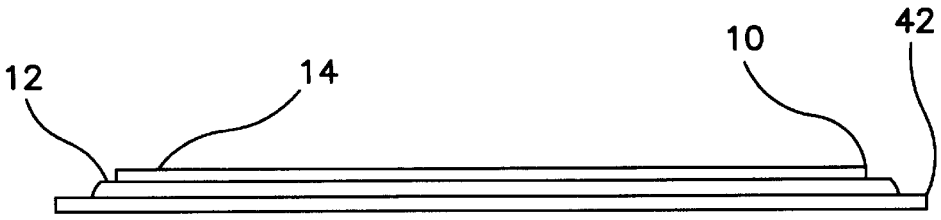
FIG. 10 is a side view of the drumhead and externally mounted adjustable damping system shown in FIG. 9.
Figure 15:
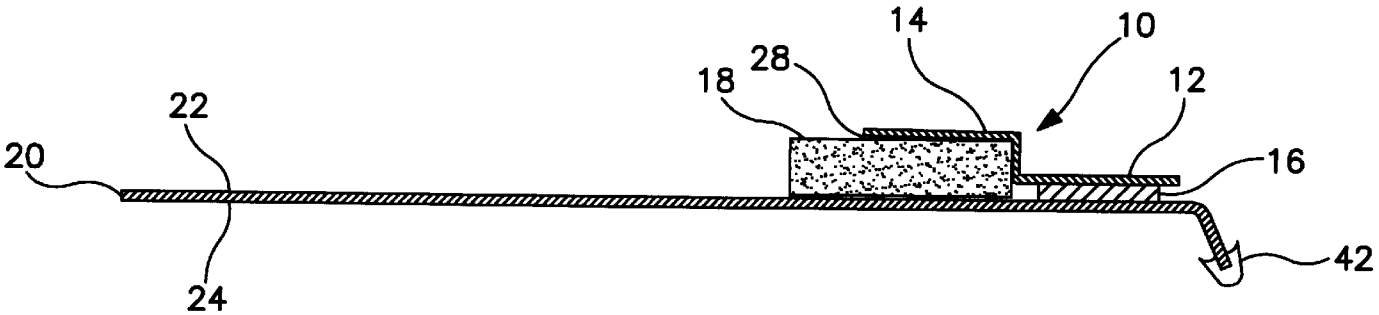
FIG. 15 is a partial sectional view through the drumhead and externally mounted adjustable damping system for drumhead shown in FIG. 9, taken along line 15—15 thereof.

FIGS. 9, 10 and 15 illustrate a drumhead 20 with an embodiment of the externally mounted adjustable damping system 10 installed. As is best seen in FIG. 15, the damping element 18 is inserted into the annular channel 28 where it rests adjacent to the outside surface 22 of the drumhead 20. The annular damping element 18 fills the annular channel 28 and is retained in position between the inward portion 14 of the mounting fixture 13 and the outer surface 22 of the drumhead 20. In such an arrangement, the damping element 18 need not be fixed to either the outer surface 22 or the mounting fixture 13 to be retained in position. As can be seen in FIG. 9, some portion of the clamping element may be visible inwardly of the inward portion 14 of the mounting fixture. The portion of the damping element 18 visible upon installation will vary depending upon the radial dimension A, B of the damping element.

Figure 13:
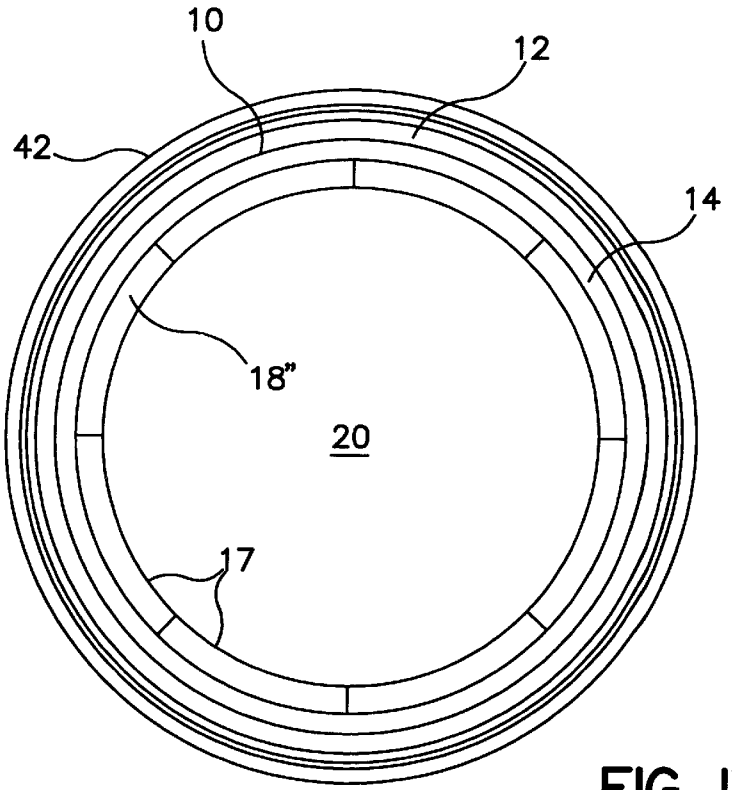
FIG. 13 is a front view of a drumhead including an externally mounted adjustable damping system for a drumhead utilizing the damping element shown in FIGS. 11 and 12 in accordance with the present invention.
Figure 11:
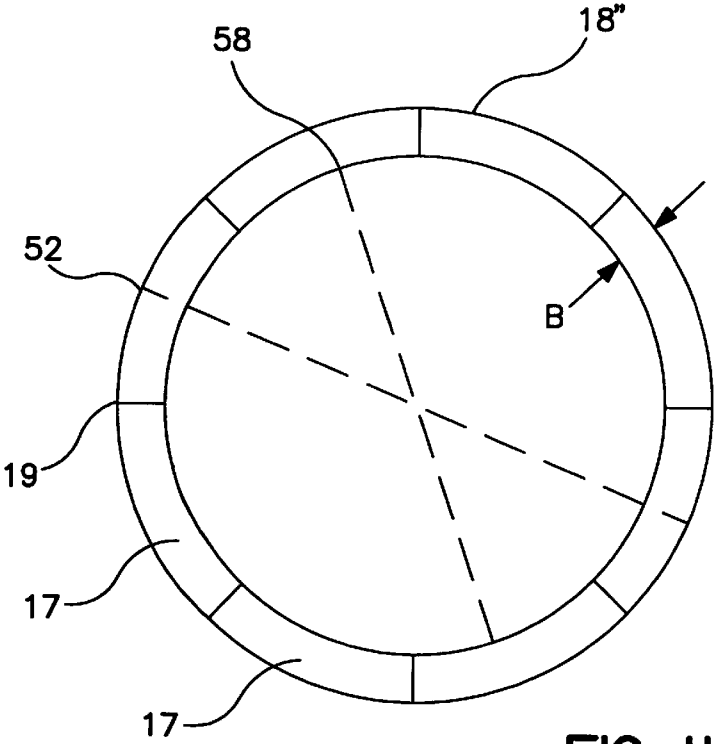
FIG. 11 is a front view of a still further alternative embodiment of a damping element in accordance with the present invention.
Figure 12:
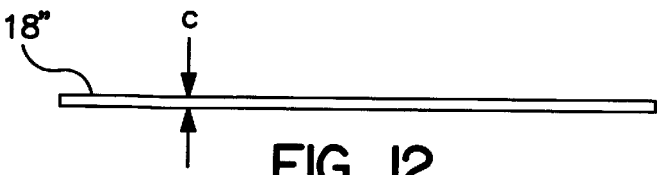
FIG. 12 is a side view of the damping element shown in FIG. 11.

FIGS. 11 and 12 illustrate an alternative embodiment of the damping element 18" having the same radial dimension B, axial thickness C, outer diameter 52 and inner diameter 58 as damping element 18. Alternative damping element 18" is divided by perforations 19 into arcuate segments 17. FIGS. 13 and 14 illustrate a drumhead equipped with the externally mounted adjustable damping system 10 utilizing the perforated damping element 18". All of the arcuate segments 17 may be used (as illustrated) or individual segments may be positioned as needed for tuning purposes.

Figure 17:
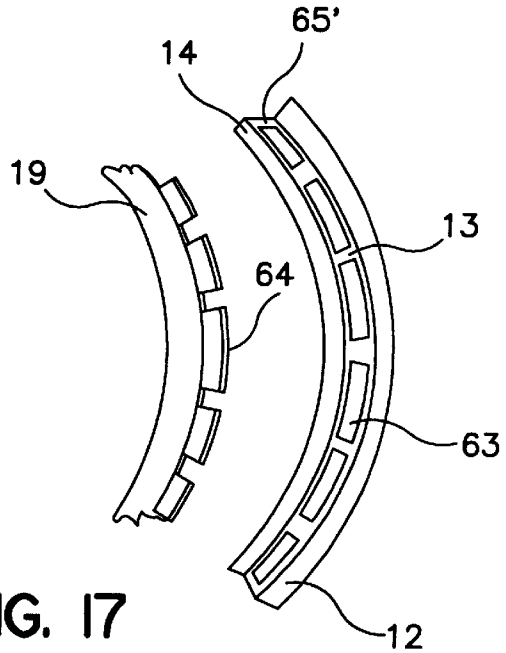
FIG. 17 is a partial perspective view of an alternative damping element and an alternative mounting fixture.
Figure 18:
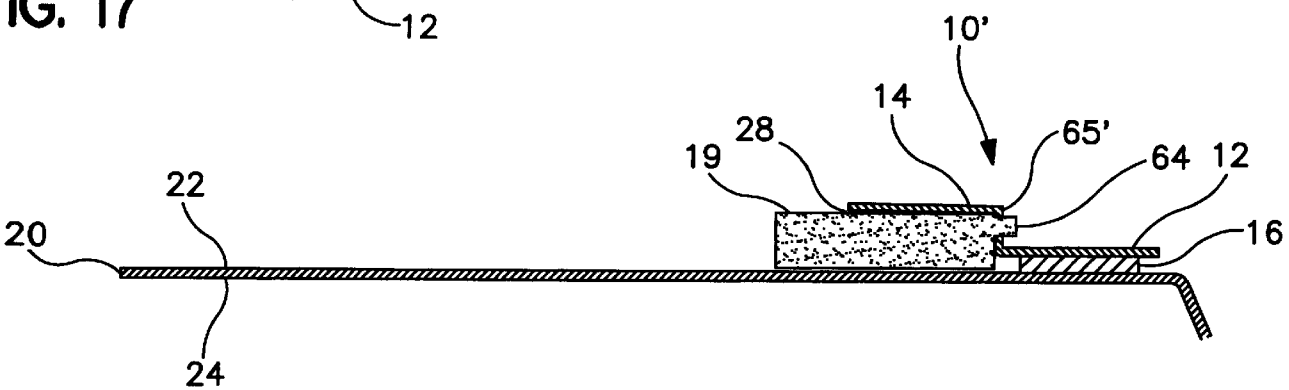
FIG. 18 is a sectional view of an externally mounted adjustable damping system for drumhead incorporating the damping element and mounting fixture of FIG. 17 and mounted to a drumhead.

FIGS. 17 and 18 illustrate an alternative configuration of damping element 19 and mounting fixture 13'. A perforated connecting ring 65' connects the radially outward portion 12 to the radially inward portion 14 of the mounting fixture 13. The connecting ring is perforated with openings 63 configured to cooperate with radially extending tabs 64 projecting from the outer edge of damping element 19. Arcuate segments of damping element 19 are retained in annular channel 28 by passing the tabs 64 through openings 63. This attachment, while not permanent, is secure enough to retain the segments of damping element in place during use. Of course, alternative configurations of opening and tab are possible without departing from the spirit and the scope of the present invention.

It must be understood that the externally mounted adjustable damping system for drumhead provides several means for adjusting the sound properties of a drumhead. Alternative damping element materials, densities and compositions will have substantially different vibration damping properties. For example, a damping element of felt will absorb vibrations differently than a damping element of foam.

The dimensions of each annular damping ring or arcuate damping segment may also be varied. A damping element having a narrow radial dimension A will have less damping capability than a damping element having a wider radial dimension B. Additionally, varying axial dimension C will affect the vibration absorbing characteristics of the damping system. Since the axial dimension of the annular channel 28 defined by the mounting fixture 13 is substantially fixed. A damping element having a larger axial dimension will be held more securely against the outside surface 22 of the drumhead 20 when placed within the annular channel 28. Conversely, a damping element having a smaller axial dimension will be more loosely held in the annular channel 28. Still further, the segmented damping element 18" permits insertion of only certain segments 17 and permits the arrangement of those segments in the annular channel 28 as desired. Thus, the externally mounted adjustable damping system for drumhead 10 permits an almost infinite variation of drumhead damping by variation of damping element materials, dimensions and the pattern of damping element installation.

Figure 16:
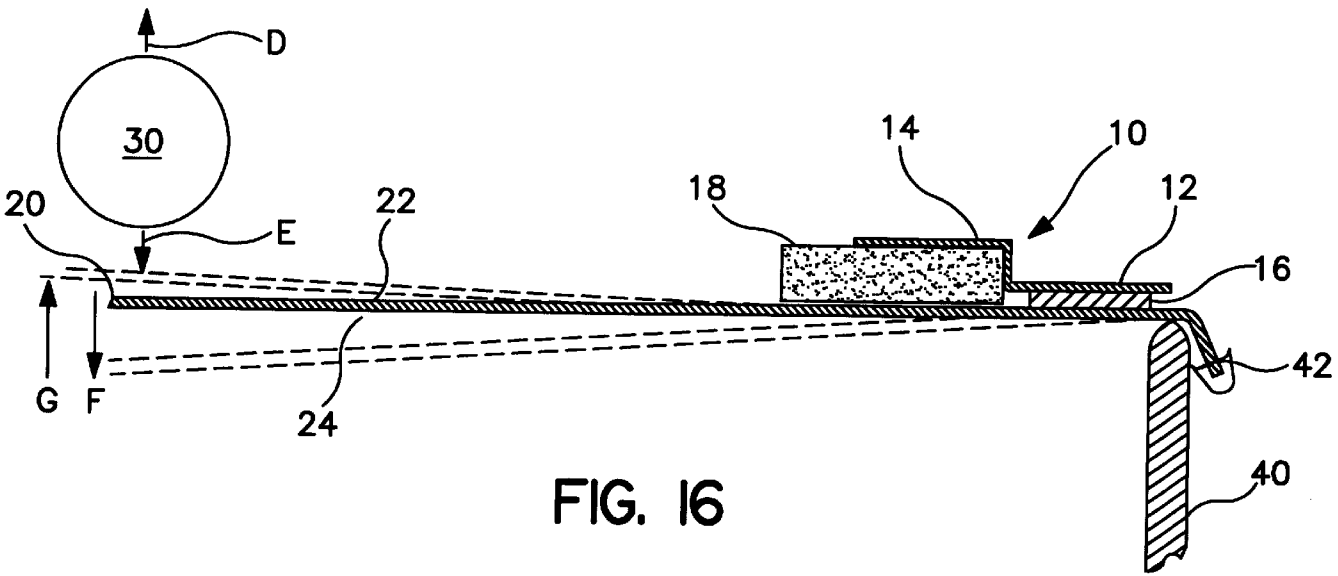
FIG. 16 is a partial sectional view of a drumhead and externally mounted adjustable damping system for drumhead mounted to a drum shell and struck by a beater.

The operation of the externally mounted adjustable damping system for drumhead is best discussed with reference to FIG. 16. FIG. 16 illustrates the externally mounted adjustable damping system 10 mounted to a drumhead 20 which is stretched over a drum shell 40. A beater moving initially in the direction indicated by arrow E and retrieved in the direction indicated by arrow D strikes the outside surface 22 of the drumhead 20. The impact of the beater 30 induces a vibration in the drumhead membrane 20 oscillating along arrows F and G.

The initial impact of the beater 30 displaces the drumhead membrane along arrow F toward the interior of the drum shell 40. As can be seen from FIG. 16, this initial movement of the drumhead membrane 20 is away from the damping element 18 and thus is substantially unaffected by the presence of the damping element. Subsequent membrane movement in the direction indicated by arrow G brings the membrane outer surface 22 into contact with the damping element 18 so that the amplitude of this and subsequent vibrations of the drumhead membrane are reduced by the presence of the damping element 18.

Arrangement of the damping element 18 on the periphery of the drumhead 20 has the desirable effect that the externally mounted adjustable damping system primarily attenuates the most undesirable vibrations of a synthetic drumhead. It should be readily apparent to one of ordinary skill in the art that altering the configuration, material and placement of the damping element 18 or segments 17 must alter the vibration absorbing characteristics of the resulting externally mounted adjustable damping system 10.

The externally mounted adjustable damping system for drumhead has a number of advantages over internally placed damping systems. First, the externally mounted adjustable damping system is accessible to the user or sound engineer, making sound adjustment during use very quick and easy when compared with internally mounted systems. The drum need not be disassembled or re-tuned after each adjustment. The unattached or lightly attached damping elements are easily removed or repositioned as needed.

More importantly, the externally mounted adjustable damping system for drumhead has substantially no effect on the initial inward displacement of the drumhead membrane when a beater strikes the drum. As a result, the initial impact or attack characteristics of the drum are substantially unaffected and only subsequent vibrations of the drumhead are attenuated. If minimal damping is desired, the damping element or elements may be removed and the drum played with only the mounting fixture attached. The peripheral positioned mounting fixture desirably suppresses unnecessary overtones ordinarily produced by the radially outward portions of a plastic drumhead.

A significant disadvantage of damping systems adhesively affixed to the inner surface of a drumhead is that the damping system must be affixed to the inner surface of the drumhead prior to drumhead installation or installed though the opposite end of a drum shell. The difficulty of installing such a system through a drum shell should be obvious to those skilled in the art. The alternative of adhesively fixing an annular damping element to a drumhead prior to installation presents the very real possibility that, when the drumhead is stretched over the drum shell, the shape of the adhesively attached damping system will be affected. The radial expansion of the drumhead membrane may cause the adhesively attached annular damping element to warp, creating a situation in which portions of the damping system are held away from the drumhead while other portions are pushed against it. The unpredictable and likely undesirable results arising from such an arrangement will be obvious to those of skill in the art.

The externally mounted adjustable damping system for drumhead is easily accessible during installation and may be installed on a drumhead prior to installation on the drum shell. The unique foam tape adhesive between the drumhead membrane and the mounting fixture flexes to absorb the stresses produced by expansion of the drumhead during tensioning. The externally mounted adjustable damping system may also be applied to a drumhead following installation and tensioning.

The term damping, as used in this application, means the reduction in amplitude of vibrations induced in a drumhead membrane by the impact of a beater. Damping is frequently associated with the elimination or reduction of ringing or sustain as is known in the art. Targeted damping produces tone control, which adjusts the audible tone of a drum by suppressing some tones and not others. The externally mounted adjustable damping system permits the sound of a drum to be tuned to produce a wide range of sounds by targeting the peripheral portion of the drumhead and adjustably damping overall drumhead sustain.

While preferred embodiments of the externally mounted adjustable damping system drumhead have been illustrated in the context of bass drums, the invention is applicable to any drum where vibration damping is desired.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. In a drum for use in musical performances, said drum having a hollow cylindrical shell and including at least a first drumhead including a membrane held in tension over an open end of said shell, said shell defining a central axis passing perpendicularly through the center of said membrane, said membrane having an inner surface facing said shell and an outer surface facing away from said shell, the improvement comprising:

an annular mounting fixture including a radially outward portion secured to a peripheral region of said membrane outer surface and a radially inward portion axially spaced from said outer surface to at least partially define an annular channel that is open toward said central axis; and at least one damping element at least partially received and removably retained in said annular channel.

2. The improved drum of claim 1, wherein said at least one damping element is retained adjacent to said outer surface between the radially inward portion of said mounting fixture and said outer surface so that when said drumhead is struck to induce vibration of said membrane, said membrane initial axial movement is away from said damping element, whereby said damping element causes little attenuation of a sound produced by said initial axial movement of said membrane and said damping element causes attenuation of a sound produced by a subsequent movement of said membrane.

3. The improved drum of claim 1, wherein said at least one damping element is made from a damping material selected from the group consisting of felt, foam, non-woven fabric, rubber and paper.

4. The improved drum of claim 1, wherein the radially inward portion of the mounting fixture having a first inside diameter and said at least one damping element comprises a ring of damping material having an outside diameter, said outside diameter being greater than said first inside diameter.

5. The improved drum of claim 4, wherein said ring of damping material has an inside diameter less than said first inside diameter.

6. The improved drum of claim 4, wherein said ring of damping material has an inside diameter greater than said first diameter.

7. The improved drum of claim 1, wherein said at least one damping element comprises arcuate segments of damping material.

8. The improved drum of claim 7, wherein said arcuate segments of damping material are retained in said annular channel by attachment to said mounting fixture.

9. The improved drum of claim 1, wherein said mounting fixture is constructed of a material selected from the group consisting of plastic, wood, metal, paper and cardboard.

10. The improved drum of claim 1, wherein said radially outward and radially inward portions comprise substantially planar rings oriented substantially parallel to said membrane.

11. The improved drum of claim 10, wherein said radially outward and radially inward portions are connected by an annular ring oriented substantially perpendicular to said membrane, said annular ring defining a radially outer periphery of said annular channel.

12. The improved drum of claim 11, wherein said annular ring is interrupted by openings through said mounting fixture.

13. The improved drum of claim 1, wherein said mounting fixture is secured to said membrane by means of an adhesive material selected from the group consisting of foam tape, flexible glue, adhesive foam and temporary adhesive.

14. A mounting fixture for an adjustable damping system for a drumhead having a playing surface, comprising:

an annular mounting fixture having a radially outward portion and connected radially inward portion relative to a central axis, said radially outward portion having adhesive disposed on a bottom surface thereof for securing said mounting fixture to the playing surface of the drumhead, said radially inward portion projecting toward said central axis and offset an axial distance from said radially outward portion to at least partially define an annular channel inwardly of said radially outward portion for at least partially receiving at least one damping element.

15. The mounting fixture of claim 14, in combination with at least one damping element configured to be at least partially received and removably retained in said annular channel to form an adjustable damping system, wherein said mounting fixture is mountable to said playing surface by said adhesive whereby said annular channel is at least partially defined by said playing surface and said damping elements are retainable adjacent to said playing surface by said mounting fixture.

16. The mounting fixture of claim 14, wherein said adhesive comprises adhesively coated foam tape.

17. The adjustable damping system of claim 15, wherein said at least one damping element is comprised of a damping material selected from the group consisting of felt, foam, non-woven fabric, rubber and paper.

18. The mounting fixture of claim 14, wherein said mounting fixture is constructed of a material selected from the group consisting of poly vinyl chloride, polyester, polystyrene, cellulosics, polycarbonates, acrylonitrile-butadiene styrene copolymer and polyethylenes.

19. The mounting fixture of claim 14, wherein each of said radially outward portion and radially inward portion are substantially flat rings oriented substantially perpendicular to said central axis and said radially outward and radially inward portions are connected by an annular ring oriented substantially parallel to said central axis, said annular ring defining a radially outer extremity of said annular channel, said outer extremity having a first diameter.

20. The mounting fixture of claim 19, wherein said at least one damping element comprises a ring of said damping material, said ring having a radially outer edge having a second diameter substantially equal to said first diameter.

21. The mounting fixture of claim 19, wherein said at least one damping element is removably retainable within said annular channel by attachment to said mounting fixture.

22. The mounting fixture of claim 21, wherein said attachment is selected from the group consisting of glue, tape, hook and loop fasteners, clips, strings, wires or interlocking portions of fixture and damping element.

* * * * *